US006487297B1

(12) United States Patent
Chin-Fa

(10) Patent No.: US 6,487,297 B1
(45) Date of Patent: Nov. 26, 2002

(54) STRUCTURE OF A LOUDSPEAKER

(76) Inventor: Yen Chin-Fa, P.O. Box 82-144, Taipei (TW)

( * ) Notice: Subject to any disclaimer, the term of this patent is extended or adjusted under 35 U.S.C. 154(b) by 199 days.

(21) Appl. No.: 09/717,258

(22) Filed: Nov. 22, 2000

(51) Int. Cl.[7] ..... H04R 1/02
(52) U.S. Cl. ..... 381/345; 381/351
(58) Field of Search ..... 381/345, 351, 381/412, 417, 418, 409, 396; 181/198, 199, 171

(56) References Cited

U.S. PATENT DOCUMENTS 4,151,379 A * 4/1979 Ashworth ..... 381/345
4,385,209 A * 5/1983 Greason et al. ..... 381/345
5,078,466 A * 1/1992 MacCullouch ..... 385/26
5,287,413 A * 2/1994 Ashworth ..... 381/194
5,825,901 A * 10/1998 Hisey ..... 381/345
5,859,917 A * 1/1999 Silber et al. ..... 381/389

* cited by examiner

*Primary Examiner*—Rexford Barnie
(74) *Attorney, Agent, or Firm*—Leong C. Lei

(57) ABSTRACT

A loudspeaker includes a cylindrical sound case provided with a plurality of radial ribs thereby dividing interior of the cylindrical sound case into a plurality of chambers and a common circular space at a central portion and therefore forming a plurality of resonance chambers, a sound coil assembly including cylindrical member which is open at one side and formed with a curved surface at another, the curved surface having a center through hole, the cylindrical member being dimensioned so that the cylindrical member will be tightly engaged with the ribs when fitted into the sound case thus forming a plurality of resonance chambers, a collar having a tubular reel at one end and a curved diaphragm at another end being arranged inside the cylindrical member, and a magnet assembly including a circular iron member having a central recess in which is fitted a magnet and a magnetism permeable disc.

4 Claims, 7 Drawing Sheets

STRUCTURE OF A LOUDSPEAKER

BACKGROUND OF THE INVENTION

1. Field of the Invention

This invention is related to an improvement in the structure of a loudspeaker which can be effectively reduced in size without decreasing its output power and can be arranged at any position as required.

2. Description of the Prior Art

So far as we know, the conventional loudspeaker utilizes a resonance box to carry out its amplifying purpose and is now widely used by the public. In our general impression, loudspeakers are either shaped as a horn or a cylinder which is connected with an audio frequency amplifier and a sound source to produce amplified sound. Further, if it is desired to have larger output power from a loudspeaker, then it will be necessary to have a larger resonance box for the loudspeaker.

FIG. 1 illustrates a prior art horn type loudspeaker which comprises a base and a head pivotally mounted on the base so that the loudspeaker can be easily adjusted in orientation.

However, the collapsible structure of the conventional loudspeaker cannot effectively reduce the volume thereof. Hence, the conventional loudspeaker is bulky in volume thereby making it difficult for transportation and stowage. In addition, the conventional loudspeaker is difficult to be mounted within the engine chamber of a car.

Therefore, it is an object of the present invention to provide an improvement in the structure of a loudspeaker which can obviate and nitigate the above-noted drawbacks.

SUMMARY OF THE INVENTION

This invention is related to an improvement in the structure of a loudspeaker.

It is the primary object of the present invention to provide an improvement in the structure of a loudspeaker which can be effectively reduced in size without decreasing its output power.

It is another object of the present invention to provide an improvement in the structure of a loudspeaker which can be arranged at any position as required.

It is still another object of the present invention to provide an improvement in the structure of a loudspeaker which is low cost It is still another object of the present invention to provide an improvement in the structure of a loudspeaker which has a steady and loud output.

It is a further object of the present invention to provide an improvement in the structure of a loudspeaker which includes loudspeaker includes a cylindrical sound case provided with a plurality of radial ribs thereby dividing interior of the cylindrical sound case into a plurality of chambers and a common circular space at a central portion and therefore forming a plurality of resonance chambers, a sound coil assembly including cylindrical member which is open at one side and formed with a curved surface at another, the curved surface having a center through hole, the cylindrical member being dimensioned so that the cylindncal member will be tightly engaged with the ribs when fitted into the sound case thus forming a plurality of resonance chambers, a collar having a tubular reel at one end and a curved diaphragm at another end being arranged inside the cylindrical member, and a magnet assembly including a circular iron member having a central recess in which is fitted a magnet and a magnetism permeable disc.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
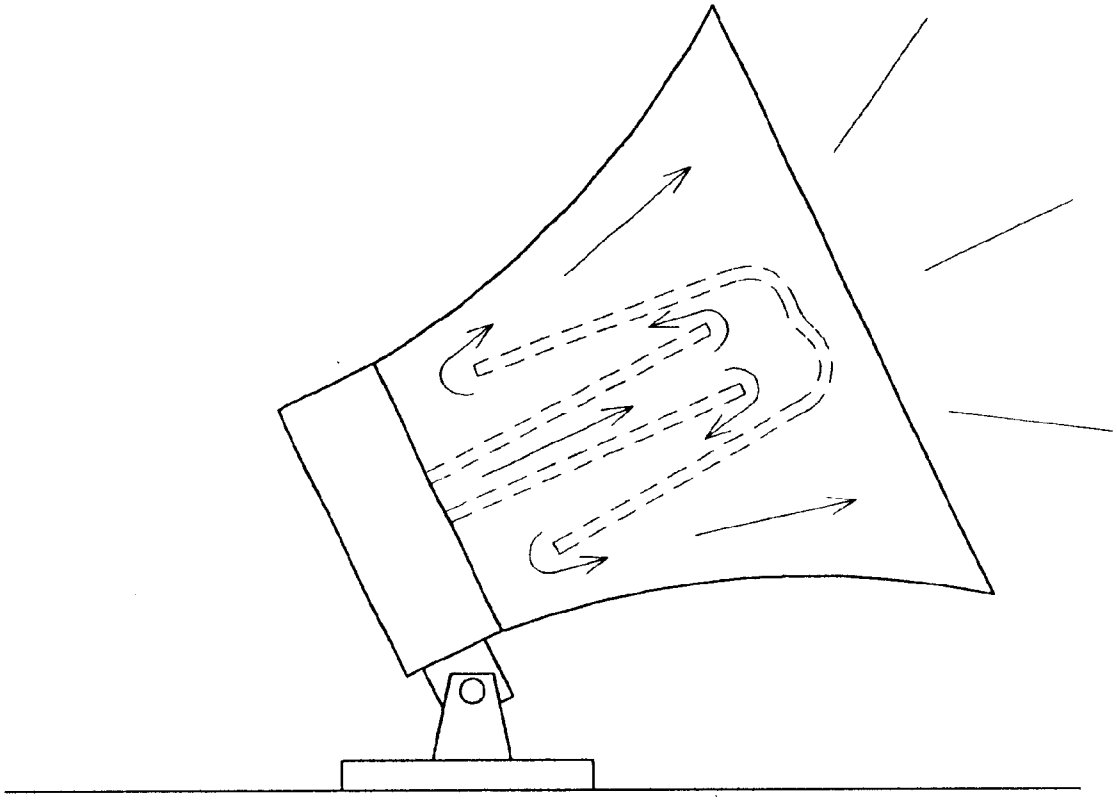
PRIOR ART FIG. 1
FIG. 1 illustrates a conventional loudspeaker.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
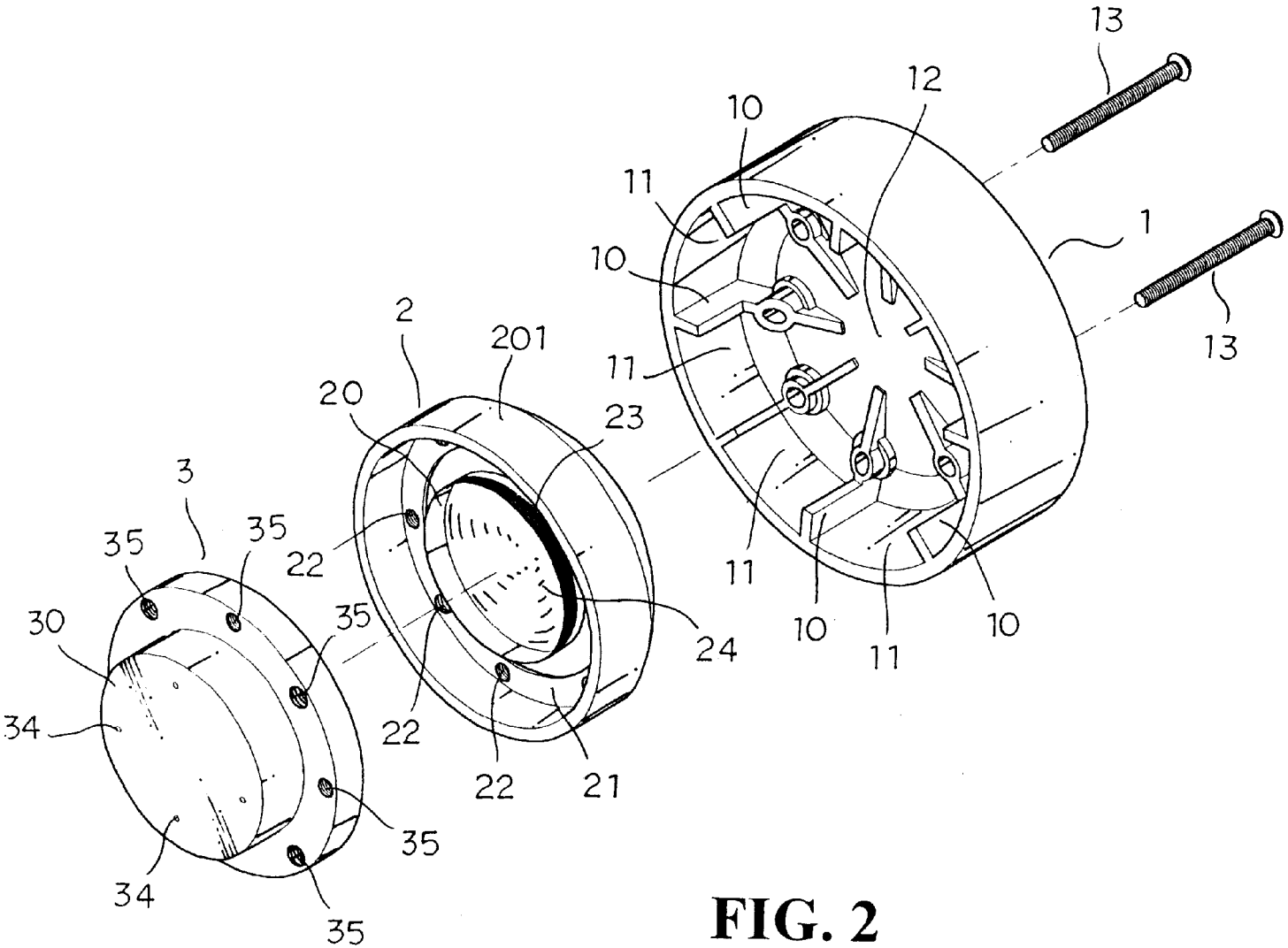
FIG. 2 is an exploded view of the present invention.
Figure 3:
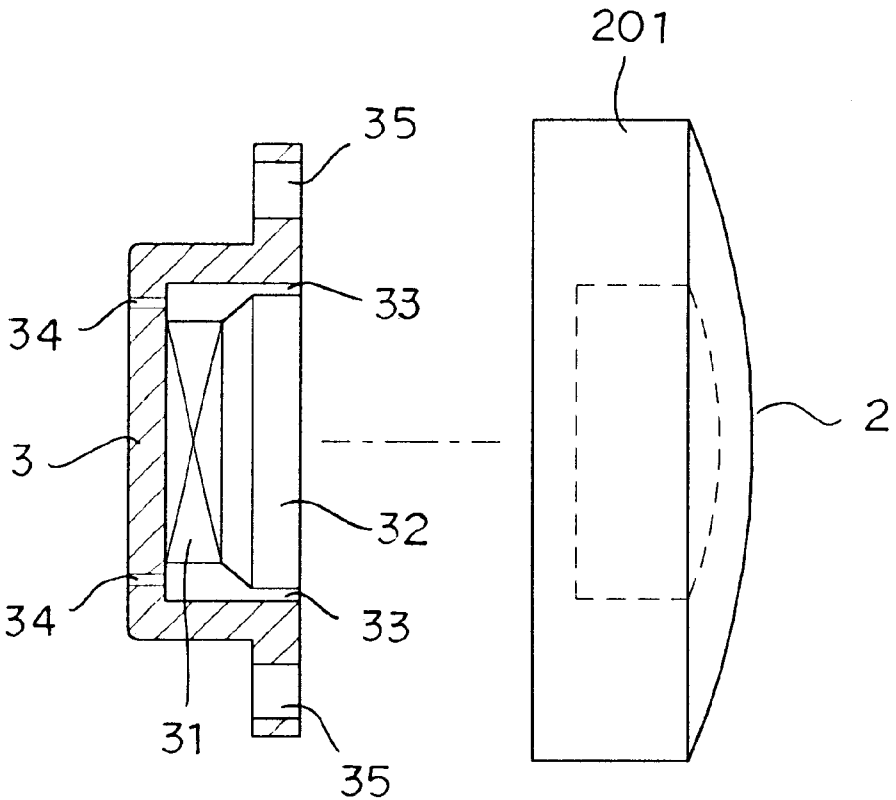
FIG. 3 is a sectional exploded view of the present invention.

With reference to the drawings and in particular to FIGS. 2 and 3 thereof, the loudspeaker according to the present invention generally comprises a sound case 1, a sound coil assembly 2 and a magnetic assembly 3.

The sound case 1 is a cylindrical member provided with a plurality of radial ribs 10 thereby dividing the interior of the cylindrical member into a plurality of chambers 11 and a common circular space 12 at the central portion and therefore forming a plurality of resonance chambers.

The sound coil assembly 2 includes a cylindrical member 201 which is open at one side and formed with a curved surface at the other. The curved surface has a through hole 28 at the center. The cylindrical member 201 is dimensioned so that it will be tightly engaged with the ribs 10 when fitted into the sound case 1 thus forming a plurality of resonance chambers 11. A collar 21 which has a tubular reel 20 at one end and a curved diaphragm 24 at the other is arranged inside the cylindrical member 201. The collar 21 is further formed with a plurality of equidistant holes 22 on its circumference. A length of insulated metal wire 23 is wound around the surface of the cylindrical reel 20 so that current passing in the insulated metal wire 23 will create a magnetic field which couples with the winding. The diaphragm 24 has a similar curvature as the curved surface of the cylinder member 201, but is not in contact therewith.

The magnet assembly 3 includes a circular iron member 30 having a central recess in which is fitted a magnet 31 and a magnetism permeable disc 32 (see FIG. 3). There is a circumferential clearance 33 between the magnetism permeable disc 32 and the inner side of the circular iron member 30, so that the tubular reel 20 can be fitted into the circular iron member 30. The circular iron member 30 is formed with a plurality of perforations 34 and has a flange formed with a plurality of threaded holes 35 aligned with the holes 22 of the cylindrical member 201.

Figure 4:
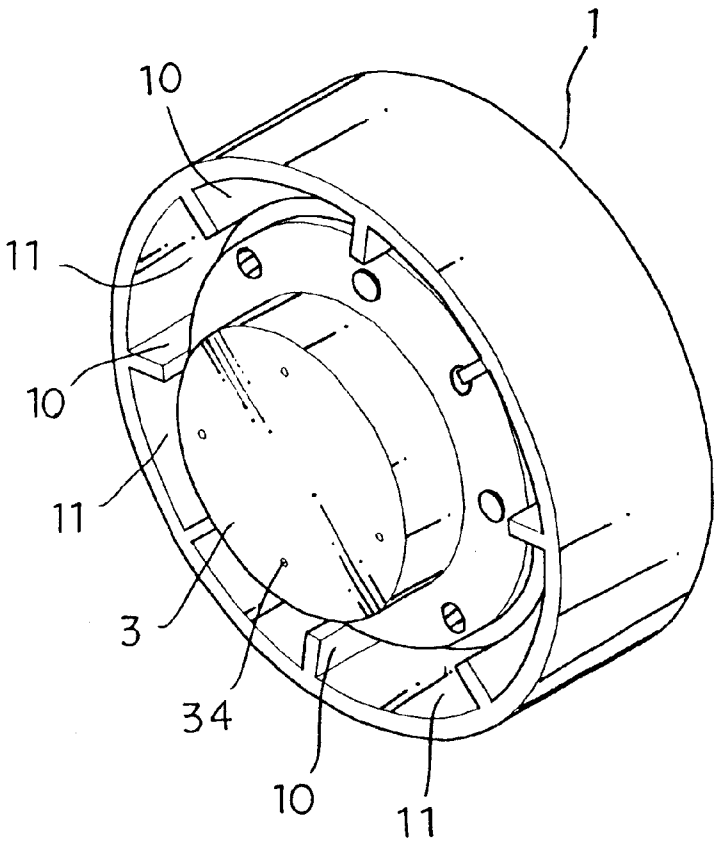
FIG. 4 is a perspective view of the present invention.

When in assembly, the sound coil assembly 2 and the magnet assembly 3 are arranged into the sound case 1 in order, with the holes 22 of the cylindrical member 201 aligned with the threaded holes 35 of the circular iron member 30. Then, a plurality of screws 13 extend through the ribs 10 of the sound case 1 and the holes 22 of the cylindrical member 201 to engage with the threaded holes 35 of the circular iron member 30 thereby forming a compact loudspeaker with a plurality of resonance chambers (see FIG. 4).

Figure 5:
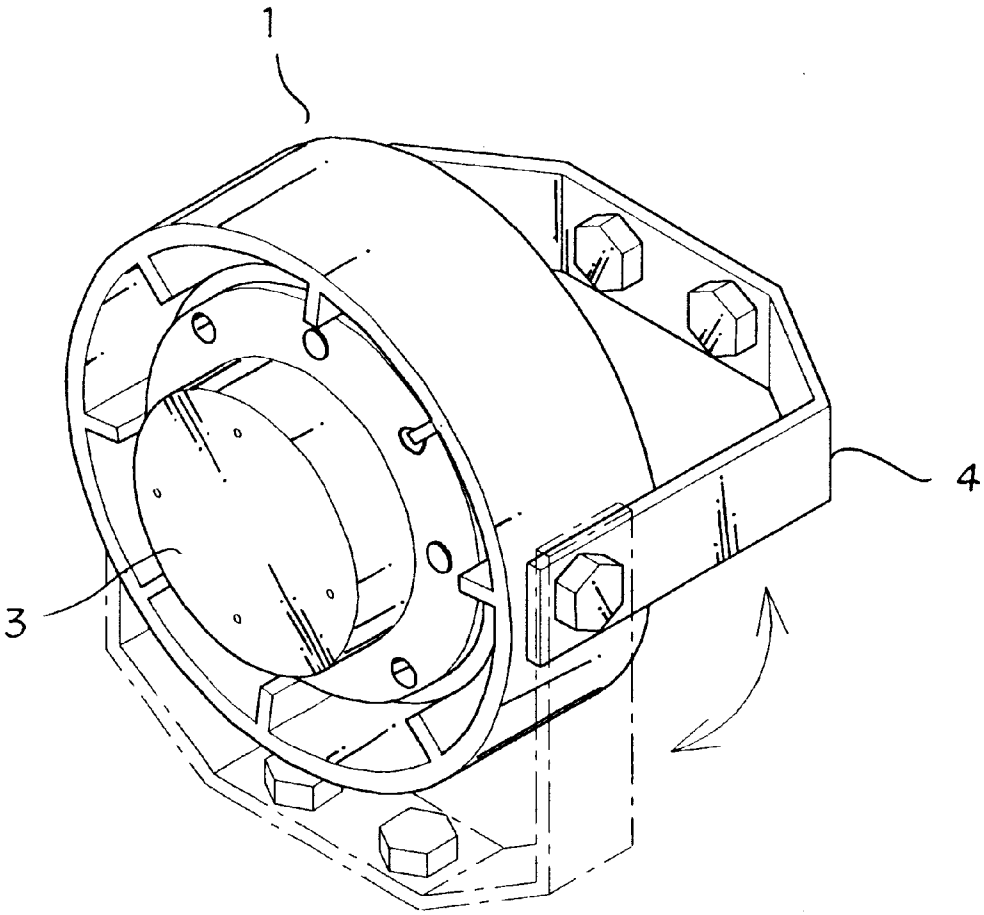
FIG. 5 illustrates a second preferred embodiment of the present invention.
Figure 6:
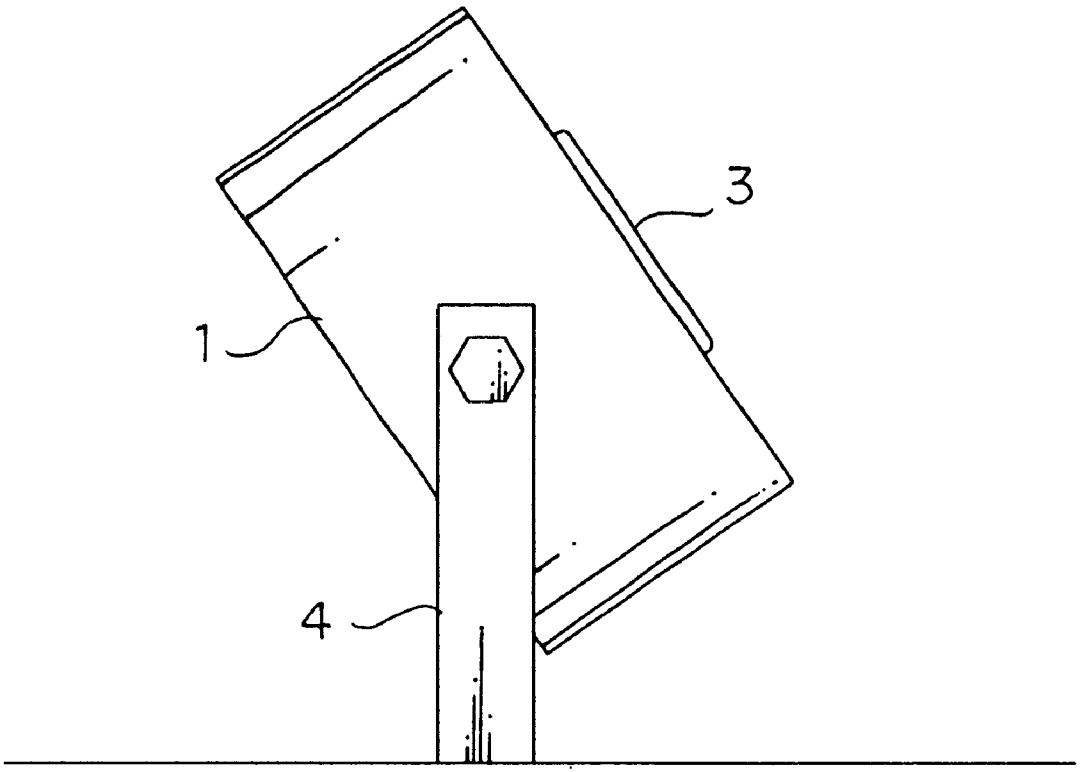
FIG. 6 illustrates an application of the second preferred embodiment.
Figure 7B:
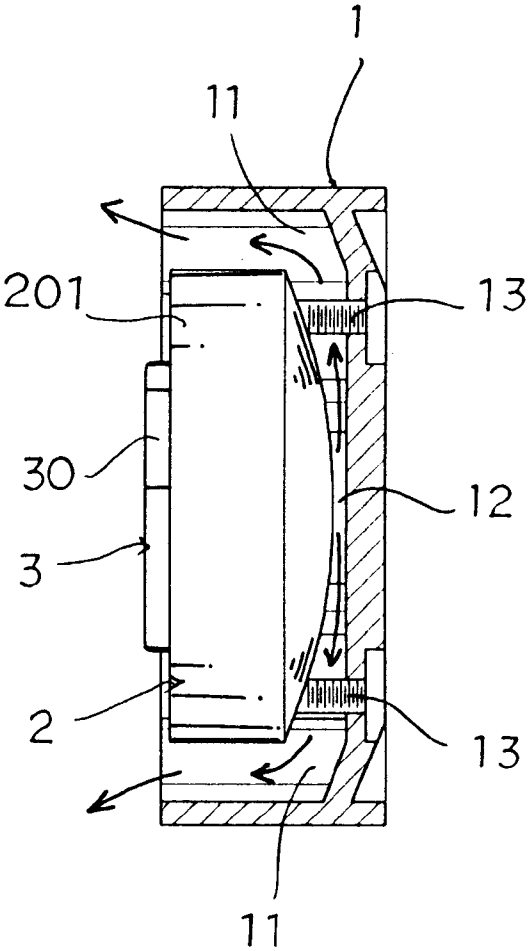
FIGS. 7A and 7B illustrate the working principle of the present invention.
Figure 7A:
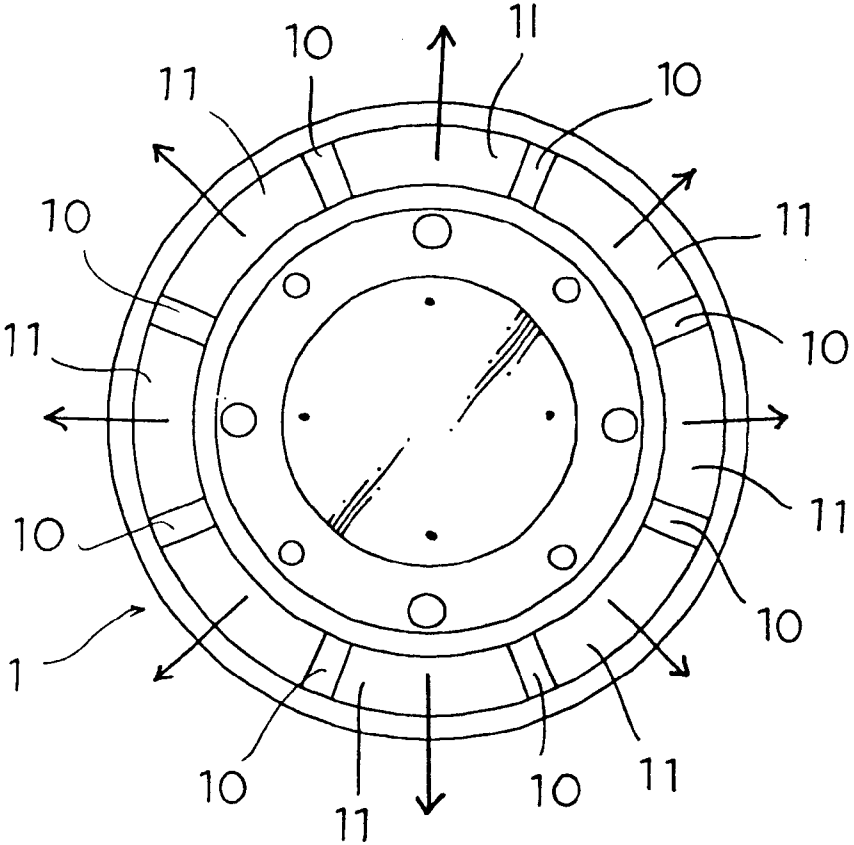

Accordingly, the user may connect the present invention with a suitable circuit to obtain the desired amplifying effect In addition, the sound case 1 may be provided with a pivotally mounted U-shaped member 4 so that the present invention can be suspended or arranged on the floor in any orientation as required (see FIGS. 5 and 6). As the sound case 1 has a plurality of isolated resonance chambers 11 and a common circular space 12 at the central portion, the sound wave will go in radial directions to the resonance chambers 11 so that the sound wave will be steady and loud (see FIGS. 7A and 7B).

In conclusion, the loudspeaker according to the present invention can be effectively reduced in size without decreasing the output power and can be arranged at any position as required.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A loudspeaker comprising:

a cylindrical sound case provided with a plurality of radial ribs thereby dividing interior of said cylindrical sound case into a plurality of chambers and a common circular space at a central portion and therefore forming a plurality of resonance chambers;

a sound coil assembly including cylindrical member which is open at one side and formed with a curved surface at another, said curved surface having a center through hole, said cylindrical member being dimensioned so that said cylindrical member will be tightly engaged with said ribs when fitted into said sound case thus forming a plurality of resonance chambers, a collar having a tubular reel at one end and a curved diaphragm at another end being arranged inside said cylindrical member; and a magnet assembly including a circular iron member having a central recess in which is fitted a magnet and a magnetism permeable disc.

2. The loudspeaker as claimed in claim 1, wherein a length of insulated metal wire is wound around surface of said cylindrical reel.

3. The loudspeaker as claimed in claim 1, wherein said diaphragm has a similar curvature as said curved surface of said cylindrical member, but is not in contact therewith.

4. The loudspeaker as claimed in claim 1, further comprising a U-shaped member adjustably mounted on said sound case.

* * * * *